US006744303B1

(12) United States Patent
Maley

(10) Patent No.: US 6,744,303 B1
(45) Date of Patent: Jun. 1, 2004

(54) METHOD AND APPARATUS FOR TUNNELING LEAKAGE CURRENT COMPENSATION

(75) Inventor: Reading Maley, San Francisco, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

(21) Appl. No.: 10/371,944

(22) Filed: Feb. 21, 2003

(51) Int. Cl.[7] ..... G05F 1/10

(52) U.S. Cl. ..... 327/538; 327/543; 327/427; 323/315; 323/316

(58) Field of Search ..... 327/538–547, 327/427, 434, 581; 323/312, 315, 316

(56) References Cited

U.S. PATENT DOCUMENTS 6,255,897 B1 * 7/2001 Klemmer ..... 327/538
6,617,835 B2 * 9/2003 Nishimura ..... 323/313
6,683,489 B1 * 1/2004 Eker ..... 327/538

* cited by examiner

*Primary Examiner*—Long Nguyen
(74) *Attorney, Agent, or Firm*—Gunnison, McKay & Hodgson, L.L.P.; Phillip J. McKay

(57) ABSTRACT

A method and apparatus for compensating for tunneling leakage current through a first capacitor includes: an operational amplifier, connected in a negative feedback configuration; a first compensation transistor; a second compensation transistor; and a compensation capacitor. The compensation capacitor is chosen so that the ratio of the area of the compensation capacitor divided by the area of the first capacitor is an area ratio "AR". The operational amplifier sets the gate voltage of the compensation capacitor to be the same as the gate voltage of the first capacitor. The ratio of the size of the second compensation transistor divided by the size of the second compensation transistor is also the area ration "AR". Consequently, the first compensation transistor and the second compensation transistor drain current out of the compensation capacitor and first capacitor, respectively, approximately equal to the amount tunneling leakage current through the compensation capacitor and first capacitor, respectively.

22 Claims, 1 Drawing Sheet

METHOD AND APPARATUS FOR TUNNELING LEAKAGE CURRENT COMPENSATION

FIELD OF THE INVENTION

The present invention relates generally to MOS circuits and, more particularly, to compensation for tunneling leakage current in MOS circuits.

BACKGROUND OF THE INVENTION

It is common practice to use the existing gate oxide, or dielectric between the gate and bulk node of a MOS device, typically a PMOS or NMOS device, as a dielectric for making the MOS device into a capacitor. A typical configuration for making a PMOS device into a capacitor is to connect the source and the drain, also collectively called diffusions in this configuration, and the N-well tie to a first supply voltage, typically Vdd. The gate is then connected to the desired node, which is typically coupled to other devices. Typically, the desired node has a more negative potential on it than the potential on the source and the drain, i.e., the diffusions.

In this capacitor configuration of a PMOS device, there could be a DC current flowing from the source and drain, i.e., the diffusions, through the oxide into the gate terminal, particularly if the oxide is very thin. This DC current flowing from the source and the drain to the gate is a parasitic current known to those of skill in the art as "gate capacitor leakage current" or simply "gate current". Herein, gate capacitor leakage current, or gate current, is also referred to as "tunneling leakage current".

In the prior art, i.e., in 0.25 micron or greater processes, the thickness of the gate oxide layer making up the gate was large enough that the tunneling leakage current was minimal and considered negligible and, therefore, was often ignored. However, to accommodate smaller feature sizes, faster clock speeds, advances in low power circuits, 0.18, 0.15, 0.13 micron processes are becoming the standard, and the thickness of gate oxide layers has been steadily decreasing. Indeed, at the time of this application gate oxide layer thickness is approaching 20 angstroms and will soon be even thinner. Consequently, the ability of the gate oxide layer to insulate, and thereby keep the tunneling leakage current minimal, is constantly decreasing. As a result, in deep submicron semiconductor processes, tunneling leakage current is no longer considered negligible and is seen as a serious problem.

Unfortunately, tunneling leakage current may vary as an exponential function of the voltage between the gate and the source (Vgs) of the MOS device. In addition, when the MOS device is configured as a capacitor, i.e., the gate is used as a capacitor, it is particularly difficult to compensate for tunneling leakage current since the gate often needs to remain a "floating node" and, therefore, cannot be driven by any external voltage source to create a corrective biasing Vgs.

Some prior art "solutions" have been attempted to "solve" the problem of tunneling leakage current, however, these solutions: tended to significantly change the characteristics of the capacitor, and therefore affect the efficiency and operational parameters; were often based on the use of non-standard, ultra precise custom components; and/or required a prohibitively large number of additional components.

For instance, prior art "work around" solutions included reducing the operational range of the capacitor or changing the diffusion and well voltage potentials to match the gate potential. Another prior art "solution" to the tunneling leakage current problem was to use two identical capacitors, each having one-half the capacitance of the active capacitor. According to this prior art "solution", one capacitor's diffusions were configured like the active capacitor and the other capacitor was connected to the floating node while the gate oxide layer was connected to the second supply voltage, Vss. The thought behind this prior art "solution" was to drain off a current equal to the gate leakage current. However, two capacitors rarely have identical characteristics and this prior art "solution" required two capacitors. In addition, the resulting circuit was more susceptible to power supply noise.

As discussed above, the prior art "solutions" shown above tended to significantly change the characteristics of the capacitor, and therefore affect the efficiency and operational parameters of the filter, were based on the use of non-standard, ultra precise custom components, and/or required a significant number of additional components. Consequently, the prior art "solutions" were, at best, flawed work arounds that failed to effectively address the problem of tunneling leakage current discussed above. Therefore, in the prior art, either: the gate oxide layer thickness was increased, a very costly and undesirable option; tunneling leakage current was simply assumed and designed around; or the use of MOS devices as filter capacitors was abandoned completely.

Tunneling leakage current is particularly problematic when the MOS device, configured as a capacitor as discussed above, is used as a filter capacitor in a PLL. In these instances, tunneling leakage current leads to a significant static phase error that causes setup time violations and, worse, can potentially cause loss of the lock. This is especially true if the phase-frequency detector runs at a slow speed.

What is needed is a method and apparatus for compensating for tunneling leakage current that does not significantly change the characteristics of the capacitor, uses standard components and requires a minimal number of additional components.

SUMMARY OF THE INVENTION

The present invention is directed to a method and apparatus for compensating for tunneling leakage current through a capacitor. According to the invention, a first capacitor, in one embodiment of the invention a MOS device configured as a capacitor, has a parasitic DC tunneling leakage current "Ig". According to the present invention, tunneling leakage current Ig is compensated for by a compensation circuit.

In one embodiment of the invention, the compensation circuit includes: an operational amplifier, connected in a negative feedback configuration; a first compensation transistor; a second compensation transistor; and a compensation capacitor, in one embodiment of the invention a MOS device configured as a compensation capacitor.

According to the invention, the compensation capacitor is chosen so that the ratio of the area of the compensation capacitor divided by the area of the first capacitor is a predetermined area ratio "AR". The operational amplifier (opamp), in negative feedback, sets the gate voltage of the compensation capacitor to be the same as the gate voltage of the first capacitor.

According to the invention, the first compensation transistor and the second compensation transistor are chosen so that the ratio of the size of the second compensation transistor divided by the size of the first compensation transistor is also the area ratio "AR". Consequently, since the opamp sets the gate voltage of the compensation capacitor to be the same as the gate voltage of the first capacitor, the first compensation transistor and the second compensation transistor then drain current out of the compensation capacitor and first capacitor, respectively, approximately equal to the amount tunneling leakage current through the compensation capacitor and first capacitor, respectively. Therefore, the potentially adverse effects of the tunneling leakage current Ig through the first capacitor are neutralized by the current drained off through second compensation transistor.

Using the method and apparatus of the present invention, tunneling leakage current is compensated for without changing the characteristics of the capacitor and by using standard components. In addition, the method and apparatus of the present invention requires a minimal number of additional components.

It is to be understood that both the foregoing general description and following detailed description are intended only to exemplify and explain the invention as claimed.

BRIEF DESCRIPTION OF THE DRAWINGS

The accompanying drawings, which are incorporated in, and constitute a part of this specification, illustrate embodiments of the invention and, together with the description, serve to explain the advantages and principles of the invention. In the drawings.

DETAILED DESCRIPTION

Figure 1:
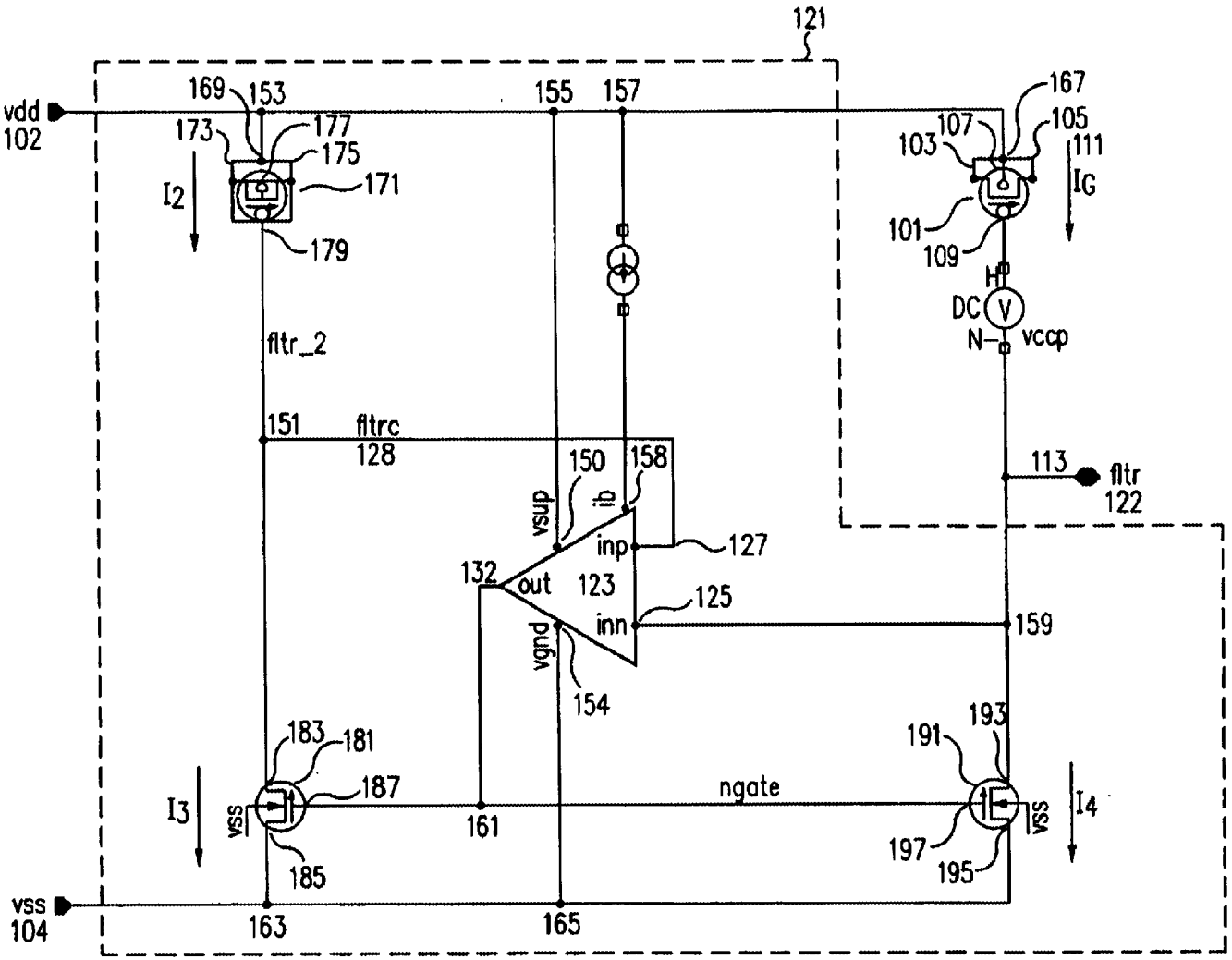
FIG. 1 is a schematic diagram of a compensation circuit designed according to the invention coupled to a MOS capacitor according to the principles of the present invention.

The invention will now be described in reference to the accompanying drawings. The same reference numbers may be used throughout the drawings and the following description to refer to the same or like parts.

The present invention is directed to a method and apparatus for compensating for tunneling leakage current (Ig in FIG. 1) through a capacitor. According to the invention, a first capacitor(101 in FIG. 1), in one embodiment of the invention a PMOS device configured as a capacitor, has a parasitic DC tunneling leakage current "Ig". According to the present invention, tunneling leakage current Ig is compensated for by a compensation circuit (121 in FIG. 1).

In one embodiment of the invention, the compensation circuit includes: an operational amplifier (123 in FIG. 1), connected in a negative feedback configuration; a first compensation transistor(181 in FIG. 1); a second compensation transistor(191 in FIG. 1); and a compensation capacitor(171 in FIG. 1), in one embodiment of the invention a PMOS device configured as a compensation capacitor.

According to the invention, the compensation capacitor is chosen so that the ratio of the area of the compensation capacitor divided by the area of the first capacitor is a predetermined area ratio "AR". The operational amplifier (opamp), in negative feedback, sets the gate voltage of the compensation capacitor (fltrc in FIG. 1) to be the same as the gate voltage of the first capacitor (fltr in FIG. 1).

According to the invention, the first compensation transistor and the second compensation transistor are chosen so that the ratio of the size of the first compensation transistor divided by the size of the second compensation transistor is also the area ratio "AR". Consequently, since the opamp sets the gate voltage of the compensation capacitor to be the same as the gate voltage of the first capacitor, the first compensation transistor and the second compensation transistor then drain current out of the compensation capacitor and first capacitor, respectively, approximately equal to the amount tunneling leakage current through the compensation capacitor and first capacitor, respectively. Therefore, the potentially adverse effects of the tunneling leakage current Ig through the first capacitor are neutralized by the current drained off through second compensation transistor.

Using the method and apparatus of the present invention, tunneling leakage current is compensated for without changing the characteristics of the capacitor and by using standard components. In addition, the method and apparatus of the present invention requires a minimal number of additional components.

FIG. 1 is a schematic diagram of a compensation circuit 121 designed according to the invention coupled to a capacitor 101, also referred to herein as first capacitor 101, according to the principles of the present invention.

As shown in FIG. 1, capacitor 101 includes: a source, or first electrode, 103; a drain, or second electrode, 105; a bulk or body tie, 107; and a gate, or control electrode, 109.

The configuration for making a MOS device into capacitor 101 shown in FIG. 1 is to connect source 103 and drain 105, also collectively called diffusions 103 and 105 in this configuration, and bulk tie 107 to a fourth node 167 and first supply voltage 102, typically Vdd. Gate 109 is then connected to the desired first node 113, also referred to herein as first node 113, which is typically coupled to other devices such as a Voltage Controlled Oscillator (VCO) in a Phase-Locked-Loop (PLL) application (not shown). In one embodiment, first node 113 has a more negative potential on it than the potential on source 103 and drain 105, i.e., the diffusions 103 and 105, and the MOS device making up capacitor 101 is a PMOS device. However, those of skill in the art will readily recognize that the MOS device making up capacitor 101 could, in other embodiments, be an NMOS device with different supply voltages and minor circuit variations well known to those of skill in the art.

As discussed above, in the configuration of a MOS device as capacitor 101, there is a parasitic DC tunneling leakage current Ig flowing from source 103 and drain 105, i.e., diffusions 103 and 105, through the oxide layer (not shown) of gate 109 to gate 109 and first node 113 along path 111. As also discussed above, in the prior art, the thickness of the oxide or poly layer making up gate 109 was large enough that tunneling leakage current Ig was minimal and considered negligible and, therefore, was often ignored. However, the thickness of gate oxide layers has been steadily decreasing. Consequently, the ability of the gate oxide layer to insulate, and thereby keep tunneling leakage current Ig minimal, is constantly decreasing and tunneling leakage current Ig is no longer considered negligible.

As also discussed above, tunneling leakage current Ig may vary as an exponential function of the voltage between gate 109 and source 103 (Vgs) and, when a MOS device is configured as capacitor 101, i.e., gate 109 is used as a capacitor, it is particularly difficult to compensate for tunneling leakage current Ig because gate 109 must remain a "floating node" and therefore cannot be driven by any external voltage source to create a corrective biasing Vgs.

According to the present invention, tunneling leakage current Ig is compensated for by compensation circuit 121. As seen in FIG. 1, compensation circuit 121 includes: operational amplifier 123 (opamp 123), connected as shown in FIG. 1 in a negative feedback configuration; first compensation transistor 181; second compensation transistor 191; and a second MOS device configured as compensation capacitor 171.

According to one embodiment of the present invention, inverting node 125 of opamp 123 is coupled to third node 159 that is, in turn, coupled to first node 113. Consequently, input 125 of opamp 123 is kept at voltage fltr 122. The non-inverting node 127 of opamp 123 is coupled a second node 151. Consequently, input 127 of opamp 123 is kept at voltage fltrc and, as discussed below, opamp 123 keeps voltage fltrc equal to voltage fltr. Output 132 of opamp 123 is coupled to node 161 and gates 187 and 197 of first and second compensation transistors 181 and 191, respectively.

Compensation capacitor 171, like capacitor 101, is, in one embodiment of the invention, a MOS device with a first flow electrode or source 173, a second flow electrode or drain 175, and a bulk tie 177 coupled together and all coupled to fourth node 169. According to one embodiment of the invention, compensation capacitor 171 is specifically chosen so that the ratio of the width of the MOS device making up compensation capacitor 171 multiplied by the length of the MOS device making up compensation capacitor 171, i.e., the area of the MOS device making up compensation capacitor 171 is equal to one tenth the ratio of the width of the MOS device making up capacitor 101 multiplied by the length of the MOS device making up capacitor 101, i.e., the area of the MOS device making up compensation capacitor 101. Consequently, since the tunneling leakage current of a MOS device configured as a capacitor is proportional to the area of the MOS device, the tunneling leakage current from source 173 and drain 175 to gate 179 of compensation capacitor 171 is one tenth the tunneling leakage current from source 103 and drain 105 to gate 109 of capacitor 101, provided the gate voltages of capacitor 101 and compensation capacitor 171 are the same.

As discussed above, the purpose of opamp 123 is to keep the bias voltages of capacitor 101 and compensation capacitor 171 the same. As also discussed above, this is accomplished by the fact that input 125 of opamp 123 is kept at voltage fltr 122, the gate voltage of capacitor 101, and input 127 of opamp 123 is kept at voltage fltrc, the gate voltage of compensation capacitor 171, so that opamp 123 keeps voltage fltrc equal to voltage fltr. Since both capacitor 101 and compensation capacitor 171 have their diffusion electrodes coupled to first supply voltage 102, according to the invention, capacitor 101 and compensation capacitor 171 have the same voltages across their oxides, i.e., have the same bias voltage.

Since, according to the method and apparatus of the present invention, the gate voltages of capacitor 101 and compensation capacitor 171 are the kept same, the tunneling leakage current Ig of the MOS device configured as capacitor 101 is proportional to the area of the MOS device making up capacitor 101 and the tunneling leakage current I2 of the MOS device configured as compensation capacitor 171 is proportional to the area of the MOS device making up compensation capacitor 171.

Therefore, when, as according to the one embodiment of the invention discussed above, compensation capacitor 171 is specifically chosen so the ratio of the width of the MOS device making up compensation capacitor 171 multiplied by the length of the MOS device making up compensation capacitor 171 is equal to one tenth the ratio of the width of the MOS device making up capacitor 101 multiplied by the length of the MOS device making up capacitor 101, tunneling leakage current I2 from source 173 and drain 175 to gate 179 of compensation capacitor 171 is one tenth the tunneling leakage current Ig from source 103 and drain 105 to gate 109 of capacitor 101.

According to the invention, first compensation transistor 181 and second compensation transistor 191 are chosen, and designed to, have almost identical threshold voltages. Consequently, according to the invention, the threshold voltage (VTH181) of first compensation transistor 181 is approximately equal to the threshold voltage (VTH191) of second compensation transistor 191. In addition, according to the invention, the ratio of the width divided by the length of second compensation transistor 191, i.e., the size of second compensation transistor 191, is chosen such that the ratio of the width divided by the length of first compensation transistor 181, i.e., the size of first compensation transistor 181, divided by size of second compensation transistor 191 is equal to the ratio of the width of the MOS device making up compensation capacitor 171 multiplied by the length of the MOS device making up compensation capacitor 171 divided by the width of the MOS device making up capacitor 101 multiplied by the length of the MOS device making up capacitor 101. In other words, according to the present invention, if, the ratio of the area of the MOS device making up compensation capacitor 171 divided by the area of the MOS device making up capacitor 101 is area ratio "AR", then, the size of second compensation transistor 191 is chosen such that the ratio of the size of first compensation transistor 181 divided by the size of second compensation transistor 191 is also area ratio "AR".

Therefore, when, as according to the one embodiment of the invention discussed above, compensation capacitor 171 is specifically chosen so the ratio of the width of the MOS device making up compensation capacitor 171 multiplied by the length of the MOS device making up compensation capacitor 171 is equal to one tenth the ratio of the width of the MOS device making up capacitor 101 multiplied by the length of the MOS device making up capacitor 101, i.e., area ratio "AR" is equal to one-tenth (1/10), then, the size of second compensation transistor 191 is chosen such that the ratio of the size of first compensation transistor 181 divided by the size of second compensation transistor 191 is also the area ratio one-tenth (1/10).

When capacitor 101, compensation capacitor 171, first compensation transistor 181 and second compensation transistor 191 are chosen to have the same area ratios "AR" as defined above, then, tunneling leakage current Ig, through capacitor 101 is equal to tunneling leakage current I2 through compensation capacitor 171 times the area ratio "AR" and current I4 through second compensation capacitor 191 is equal to current I3 through first compensation transistor 181 times the area ratio "AR". However, current I3 through first compensation transistor 181 is equal to tunneling leakage current I2 through compensation capacitor 171. Therefore, current I4 is equal to tunneling leakage current I2 divided by the area ratio "AR" and tunneling leakage current Ig through capacitor 101 is equal to I2 divided by the area ratio "AR" so that tunneling leakage current Ig through capacitor 101 is approximately equal to the current I4 through second compensation transistor 191. The relationship below summarizes the above discussion:

$$Ig=I2/AR;$$
$$I4=I3/AR$$
$$I3=I2;$$
$$I4=I2/AR;$$
$$I4=Ig$$

Consequently, according to the method and apparatus of the present invention, tunneling leakage current Ig through capacitor 101 is approximately equal to the current I4 drained off through second compensation transistor 191. Therefore, the potentially adverse effects of tunneling leakage current Ig are neutralized by I4.

As discussed above, the method and apparatus of the present invention, tunneling leakage current is compensated for without changing the characteristics of the capacitor and by.using standard components. In addition, the method and apparatus of the present invention requires a minimal number of additional components.

As discussed above, tunneling leakage current is particularly problematic when the MOS device is used as a filter capacitor in a PLL. In these instances, tunneling leakage current leads to a significant static phase error that causes setup time violations and, worse, can potentially cause loss of the lock. This is especially true if the phase-frequency detector runs at a slow speed. Since, according to the method and apparatus of the present invention, tunneling leakage current is compensated for, the method and apparatus of the present invention is particularly well suited for applications where the MOS device, such as capacitor 101 in FIG. 1, is used as a filter capacitor in a PLL.

The foregoing description of an implementation of the invention has been presented for purposes of illustration and description only, and therefore is not exhaustive and does not limit the invention to the precise form disclosed. Modifications and variations are possible in light of the above teachings or may be acquired from practicing the invention.

For example, those of skill in the art will readily recognize that the one embodiment of compensation circuit 121, including a MOS device configured as compensation capacitor 171 that is one tenth the size of the MOS device configured as capacitor 101, was discussed above for exemplary purposes only and that other ratios for the sizes of the MOS device configured as compensation capacitor 171 and the MOS device configured as capacitor 101 can be used, including, but not limited to, same size devices, to meet the needs of the designer. The only requirement, according to the invention, is that if, the ratio of the width of the MOS device making up compensation capacitor 171 multiplied by the length of the MOS device making up compensation capacitor 171 divided by the ratio of the width of the MOS device making up capacitor 101 multiplied by the length of the MOS device making up capacitor 101 is area ratio "AR", then, the size of second compensation transistor 191 is chosen such that the ratio of the size of first compensation transistor 181 divided by the size of second compensation transistor 191 is also area ratio "AR".

In addition, those of skill in the art will readily recognize that the use of PMOS devices configured as capacitor 101 and compensation capacitor 171 in FIG. 1 was shown merely for exemplary purposes and that NMOS devices could be substituted for configuration as capacitor 101 and compensation capacitor 171 in FIG. 1 by simply reversing the supply voltages and making minor circuit modifications well known to those of skill in the art.

Also, those of skill in the art will readily recognize that the use of MOS devices configured as capacitor 101 and compensation capacitor 171 in FIG. 1 was shown merely for exemplary purposes and to show a likely structure using known techniques. However, capacitor 101 and compensation capacitor 171 can be, in other embodiments of the invention, traditional capacitors. As discussed above, the only requirement, according to the invention, is that if the ratio of the area of compensation capacitor 171 divided by the area of capacitor 101 is area ratio "AR", then, the size of second compensation transistor 191 is chosen such that the ratio of the size of first compensation transistor 181 divided by the size of second compensation transistor 191 is also area ratio "AR".

Consequently, the scope of the invention is defined by the claims and their equivalents.

What is claimed is:

1. A compensation circuit coupled to a first capacitor, said compensation circuit comprising:

a first supply voltage, said first supply voltage being coupled to said first capacitor;

a second supply voltage;

a first node, said first node being coupled to said first capacitor;

a compensation capacitor;

a first compensation transistor, said first compensation transistor having a first compensation transistor first flow electrode, a first compensation transistor second flow electrode and a first compensation transistor control electrode, said first compensation transistor first flow electrode being coupled to said compensation capacitor at a second node, said first compensation transistor second flow electrode being coupled to said second supply voltage;

a second compensation transistor, said second compensation transistor having a second compensation transistor first flow electrode, a second compensation transistor second flow electrode and a second compensation transistor control electrode, said second compensation transistor first flow electrode being coupled to said first capacitor at the first node, second compensation transistor second flow electrode being coupled to said second supply voltage, said second compensation transistor control electrode being coupled to said first compensation transistor control electrode; and an operational amplifier (opamp), said opamp having a first input coupled to said first supply voltage, said opamp having a second input coupled to said second supply voltage, said opamp having a third input coupled to said first node, said opamp having a fourth input coupled to said second node, said opamp having an output coupled to said first compensation transistor control electrode and said second compensation transistor control electrode, wherein;

said opamp provides that a bias voltage across said compensation capacitor is equal to a bias voltage across said first capacitor, further wherein;

a ratio of the area of said compensation capacitor divided by the area of said first capacitor is equal to a ratio of the size of said second compensation transistor divided by the size of said first compensation transistor such that a tunneling leakage current through said first capacitor is approximately equal a current through said second compensation transistor.

2. The compensation circuit of claim 1, further wherein;

said ratio of the area of said compensation capacitor divided by the area of said first capacitor and said ratio of the size of said second compensation transistor divided by the size of said first compensation transistor is equal to one-tenth.

3. The compensation circuit of claim 1, further wherein;

said ratio of the area of said compensation capacitor divided by the area of said first capacitor and said ratio of the size of said second compensation transistor divided by the size of said first compensation transistor is equal to one.

4. The compensation circuit of claim 1, further wherein;

said first capacitor is a first PMOS transistor configured as a capacitor, said first PMOS transistor having a first PMOS transistor first flow electrode, a first PMOS transistor second flow electrode, a first PMOS transistor control electrode, and a first PMOS transistor bulk electrode, said first PMOS transistor first flow electrode being coupled to said first PMOS transistor second flow electrode and said first PMOS transistor bulk electrode and said first supply voltage, said first PMOS transistor control electrode being coupled to said first node and said third input of said opamp.

5. The compensation circuit of claim 4, further wherein;

said compensation capacitor is a compensation PMOS transistor configured as a capacitor, said compensation PMOS transistor having a compensation PMOS transistor first flow electrode, a compensation PMOS transistor second flow electrode, a compensation PMOS transistor control electrode, and a compensation PMOS transistor bulk electrode, said compensation PMOS transistor first flow electrode being coupled to said compensation PMOS transistor second flow electrode and said compensation PMOS transistor bulk electrode, said compensation PMOS transistor control electrode being coupled to said second node and said second compensation transistor first flow electrode.

6. The compensation circuit of claim 1, further wherein;

said first capacitor is a first PMOS transistor configured as a capacitor, said first PMOS transistor having a first PMOS transistor first flow electrode, a first PMOS transistor second flow electrode, a first PMOS transistor control electrode, and a first PMOS transistor bulk electrode, said first PMOS transistor first flow electrode being coupled to said first PMOS transistor second flow electrode and said first PMOS transistor bulk electrode and said first supply voltage, said first PMOS transistor control electrode being coupled to said first node and said third input of said opamp; and said compensation capacitor is a compensation PMOS transistor configured as a capacitor, said compensation PMOS transistor having a compensation PMOS transistor first flow electrode, a compensation PMOS transistor second flow electrode, a compensation PMOS transistor control electrode, and a compensation PMOS transistor bulk electrode, said compensation PMOS transistor first flow electrode being coupled to said compensation PMOS transistor second flow electrode and said compensation PMOS transistor bulk electrode, said compensation PMOS transistor control electrode being coupled to said second node and said second compensation transistor first flow electrode.

7. The compensation circuit of claim 6, further wherein;

said ratio of the area of said compensation capacitor divided by the area of said first capacitor and said ratio of the size of said second compensation transistor divided by the size of said first compensation transistor is equal to one-tenth.

8. The compensation circuit of claim 6, further wherein;

said ratio of the area of said compensation capacitor divided by the area of said first capacitor and said ratio of the size of said second compensation transistor divided by the size of said first compensation transistor is equal to one.

9. The compensation circuit of claim 6, further wherein;

said first supply voltage is Vdd and said second supply voltage is Vss.

10. The compensation circuit of claim 9, further wherein;

said first compensation transistor is an NMOS transistor; and said second compensation transistor is an NMOS transistor.

11. The compensation circuit of claim 10, further wherein;

said ratio of the area of said compensation capacitor divided by the area of said first capacitor and said ratio of the size of said second compensation transistor divided by the size of said first compensation transistor is equal to one-tenth.

12. The compensation circuit of claim 10, further wherein;

said ratio of the area of said compensation capacitor divided by the area of said first capacitor and said ratio of the size of said second compensation transistor divided by the size of said first compensation transistor is equal to one.

13. A compensation circuit coupled to a first capacitor, said compensation circuit comprising:

a first supply voltage (Vdd), said first supply voltage being coupled to said first capacitor;

a second supply voltage (Vss);

a first node, said first node being coupled to said first capacitor;

a compensation capacitor;

a first compensation NMOS transistor, said first compensation NMOS transistor having a first compensation NMOS transistor first flow electrode, a first compensation NMOS transistor second flow electrode and a first compensation NMOS transistor control electrode, said first compensation NMOS transistor first flow electrode being coupled to said compensation capacitor at a second said first compensation NMOS transistor second flow electrode being coupled to said second supply voltage;

a second compensation NMOS transistor, said second compensation NMOS transistor having a second compensation NMOS transistor first flow electrode, a second compensation NMOS transistor second flow electrode and a second compensation NMOS transistor control electrode, said second compensation NMOS transistor first flow electrode being coupled to said first capacitor at first node, said second compensation NMOS transistor second flow electrode being coupled to said second supply voltage, said second compensation NMOS transistor control electrode being coupled to said first compensation NMOS transistor control electrode; and an operational amplifier (opamp), said opamp having a first input coupled to said first supply voltage, said opamp having a second input coupled to said second supply voltage, said opamp having a third input coupled to said first node, said opamp having a fourth input coupled to said second node, said opamp having an output coupled to said first compensation transistor control electrode and said second compensation transistor control electrode, wherein;

said opamp provides that a bias voltage across said compensation capacitor is equal to a bias voltage across said first capacitor, further wherein;

a ratio of the area of said compensation capacitor divided by the area of said first capacitor is equal to a ratio of the size of said second compensation NMOS transistor divided by the size of said first compensation NMOS transistor such that a tunneling leakage current through said first capacitor is equal a current through said second compensation NMOS transistor, further wherein;

said first capacitor is a first PMOS transistor configured as a capacitor, said first PMOS transistor having a first PMOS transistor first flow electrode, a first PMOS transistor second flow electrode, a first PMOS transistor control electrode, and a first PMOS transistor bulk electrode, said first PMOS transistor first flow electrode being coupled to said first PMOS transistor second flow electrode and said first PMOS transistor bulk electrode and said first supply voltage, said first PMOS transistor control electrode being coupled to said first node and said third input of said opamp, further wherein;

said compensation capacitor is a compensation PMOS transistor configured as a capacitor, said compensation PMOS transistor having a compensation PMOS transistor first flow electrode, a compensation PMOS transistor second flow electrode, a compensation PMOS transistor control electrode, and a compensation PMOS transistor bulk electrode, said compensation PMOS transistor first flow electrode being coupled to said compensation PMOS transistor second flow electrode and said compensation PMOS transistor bulk electrode, said compensation PMOS transistor control electrode being coupled to said second node and said second compensation transistor first flow electrode, further wherein;

said ratio of the area of said compensation capacitor divided by the area of said first capacitor and said ratio of the size of said second compensation transistor divided by the size of said first compensation transistor is equal to one-tenth.

14. A compensation circuit coupled to a first capacitor, said compensation circuit comprising:

a first supply voltage (Vdd), said first supply voltage being coupled to said first capacitor;

a second supply voltage (Vss);

a first node, said first node being coupled to said first capacitor;

a compensation capacitor;

a first compensation NMOS transistor, said first compensation NMOS transistor having a first compensation NMOS transistor first flow electrode, a first compensation NMOS transistor second flow electrode and a first compensation NMOS transistor control electrode, said first compensation NMOS transistor first flow electrode being coupled to said compensation capacitor at a second node, said first compensation NMOS transistor second flow electrode being coupled to said second supply voltage;

a second compensation NMOS transistor, said second compensation NMOS transistor having a second compensation NMOS transistor first flow electrode, a second compensation NMOS transistor second flow electrode and a second compensation NMOS transistor control electrode, said second compensation NMOS transistor first flow electrode being coupled to said first capacitor at said first node, said second compensation NMOS transistor second flow electrode being coupled to said second supply voltage, said second compensation NMOS transistor control electrode being coupled to said first compensation NMOS transistor control electrode; and an operational amplifier (opamp), said opamp having a first input coupled to said first supply voltage, said opamp having a second input coupled to said second supply voltage, said opamp having a third input coupled to said first node said opamp having a fourth input coupled to said second node, said opamp having an output coupled to said first compensation transistor control electrode and said second compensation transistor control electrode, wherein;

said opamp provides that a bias voltage across said compensation capacitor is equal to a bias voltage across said first capacitor, further wherein;

a ratio of the area of said compensation capacitor divided by the area of said first capacitor is equal to a ratio of the size of said second compensation NMOS transistor divided by the size of said first compensation NMOS transistor such that a tunneling leakage current through said first capacitor is equal a current through said second compensation NMOS transistor, further wherein;

said first capacitor is a first PMOS transistor configured as a capacitor, said first PMOS transistor having a first PMOS transistor first flow electrode, a first PMOS transistor second flow electrode, a first PMOS transistor control electrode, and a first PMOS transistor bulk electrode, said first PMOS transistor first flow electrode being coupled to said first PMOS transistor second flow electrode and said first PMOS transistor bulk electrode and said first supply voltage, said first PMOS transistor control electrode being coupled to said first node and said third input of said opamp, further wherein;

said compensation capacitor is a compensation PMOS transistor configured as a capacitor, said compensation PMOS transistor having a compensation PMOS transistor first flow electrode, a compensation PMOS transistor second flow electrode, a compensation PMOS transistor control electrode, and a compensation PMOS transistor bulk electrode, said compensation PMOS transistor first flow electrode being coupled to said compensation PMOS transistor second flow electrode and said compensation PMOS transistor bulk electrode, said compensation PMOS transistor control electrode being coupled to said second node and said second compensation transistor first flow electrode, further wherein;

said ratio of the area of said compensation capacitor divided by the area of said first capacitor and said ratio of the size of said second compensation transistor divided by the size of said first compensation transistor is equal to one.

15. A method for compensating for the tunneling leakage current of a capacitor comprising:

providing a first capacitor providing a first supply voltage;

providing a second supply voltage;

coupling said first supply voltage to said first capacitor coupling a first node to said first capacitor;

providing a compensation capacitor;

providing a first compensation transistor, said first compensation transistor having a first compensation transistor first flow electrode, a first compensation transistor second flow electrode and a first compensation transistor control electrode;

coupling said first compensation transistor first flow electrode to said compensation capacitor at a second node, coupling said first compensation transistor second flow electrode to said second supply voltage;

providing a second compensation transistor, said second compensation transistor having a second compensation transistor first flow electrode, a second compensation transistor second flow electrode and a second compensation transistor control electrode;

coupling said second compensation transistor first flow electrode to said first capacitor at said first node;

coupling said second compensation transistor second flow electrode to said second supply voltage;

coupling said second compensation transistor control electrode to said first compensation transistor control electrode;

providing an opamp, said opamp having an opamp first input, an opamp second input, an opamp third input, an opamp fourth input and an opamp output;

coupling said opamp first input to said first supply voltage;

coupling said opamp second input to said second supply voltage;

coupling said opamp third input to said first node and said second compensation transistor first flow electrode;

coupling said opamp fourth input to said second node and said first compensation transistor first flow electrode;

coupling said opamp output to said first compensation transistor control electrode and said second compensation transistor control electrode; and configuring said opamp to provide a bias voltage across said compensation capacitor that is equal to a bias voltage across said first capacitor, wherein;

said first capacitor, said compensation capacitor, said first compensation transistor, and said second compensation transistor are provided such that a ratio of the area of said compensation capacitor divided by the area of said first capacitor is equal to a ratio of the size of said second compensation transistor divided by the size of said first compensation transistor such that a tunneling leakage current through said first capacitor is equal a current through said second compensation transistor.

16. The method for compensating for the tunneling leakage current of a capacitor of claim 1, further wherein;

said ratio of the area of said compensation capacitor divided by the area of said first capacitor and said ratio of the size of said second compensation transistor divided by the size of said first compensation transistor is equal to one-tenth.

17. The method for compensating for the tunneling leakage current of a capacitor of claim 1, further wherein;

said ratio of the area of said compensation capacitor divided by the area of said first capacitor and said ratio of the size of said second compensation transistor divided by the size of said first compensation transistor is equal to one.

18. The method for compensating for the tunneling leakage current of a capacitor of claim 1, further wherein;

said first capacitor is a first PMOS transistor configured as a capacitor, said first PMOS transistor having a first PMOS transistor first flow electrode, a first PMOS transistor second flow electrode, a first PMOS transistor control electrode, and a first PMOS transistor bulk electrode, said first PMOS transistor first flow electrode being coupled to said first PMOS transistor second flow electrode and said first PMOS transistor bulk electrode and said first supply voltage, said first PMOS transistor control electrode being coupled to said first node and said third input of said opamp; and said compensation capacitor is a compensation PMOS transistor configured as a capacitor, said compensation PMOS transistor having a compensation PMOS transistor first flow electrode, a compensation PMOS transistor second flow electrode, a compensation PMOS transistor control electrode, and a compensation PMOS transistor bulk electrode, said compensation PMOS transistor first flow electrode being coupled to said compensation PMOS transistor second flow electrode and said compensation PMOS transistor bulk electrode, said compensation PMOS transistor control electrode being coupled to said second node and said second compensation transistor first flow electrode.

19. The method for compensating for the tunneling leakage current of a capacitor of claim 18, further wherein;

said first supply voltage is Vdd and said second supply voltage is Vss.

20. The method for compensating for the tunneling leakage current of a capacitor of claim 19, further wherein;

said first compensation transistor is an NMOS transistor; and said second compensation transistor is an NMOS transistor.

21. The method for compensating for the tunneling leakage current of a capacitor of claim 20, further wherein;

said ratio of the area of said compensation capacitor divided by the area of said first capacitor and said ratio of the size of said second compensation transistor divided by the size of said first compensation transistor is equal to one-tenth.

22. The method for compensating for the tunneling leakage current of a capacitor of claim 20, further wherein;

said ratio of the area of said compensation capacitor divided by the area of said first capacitor and said ratio of the size of said second compensation transistor divided by the size of said first compensation transistor is equal to one.

* * * * *